United States Patent [19]

Koizumi et al.

[11] 4,020,664

[45] May 3, 1977

[54] DEVICE FOR ADJUSTING THE PHASE OF ROLL DIES IN A CROSS-ROLLING MACHINE

[75] Inventors: Mokuji Koizumi; Yukitsugu Kobayashi, both of Hiroshima, Japan

[73] Assignee: Mitsubishi Jukogyo Kabushiki Kaisha, Tokyo, Japan

[22] Filed: Dec. 15, 1975

[21] Appl. No.: 640,566

[30] Foreign Application Priority Data

Jan. 10, 1975 Japan ..... 50-4899

[52] U.S. Cl. ..... 72/108; 72/195

[51] Int. Cl.[2] ..... B21B 31/16

[58] Field of Search ..... 72/195, 108; 83/328, 83/344; 74/392, 397, 401, 409

[56] References Cited

UNITED STATES PATENTS

| | | | |
|---|---|---|---|
| 530,949 | 12/1894 | Klatte | 72/195 |
| 2,130,069 | 9/1938 | Criley | 72/195 |

*Primary Examiner*—Lowell A. Larson

*Attorney, Agent, or Firm*—Cushman, Darby & Cushman

[57] ABSTRACT

Apparatus suitable for adjusting the phase between the roll dies in a cross rolling machine, the apparatus comprising a die roll mounted on a roll shaft for rotation by the roll shaft, a boss fixedly secured to the roll shaft for rotation therewith and a drive gear coaxial with the boss, and coupled to the boss, so as to be angularly adjustable with respect thereto, by means of an eccentric cam shaft, whereby rotation of the cam shaft causes angular displacement between the driving gear and the roll shaft.

5 Claims, 7 Drawing Figures

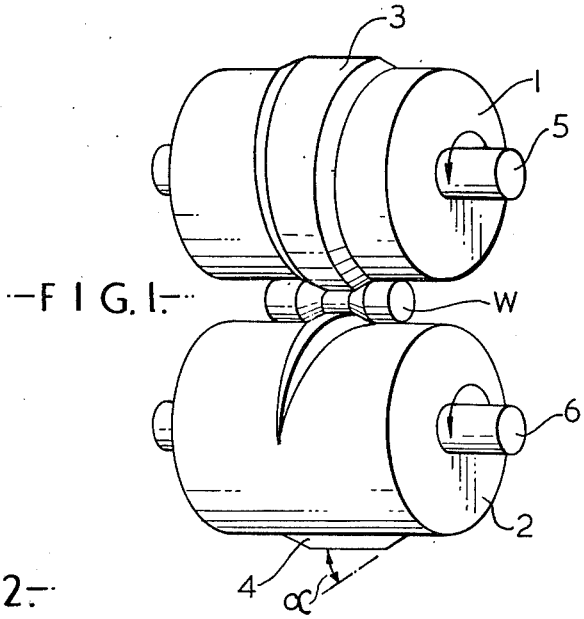
FIG. 1.
FIG. 2.
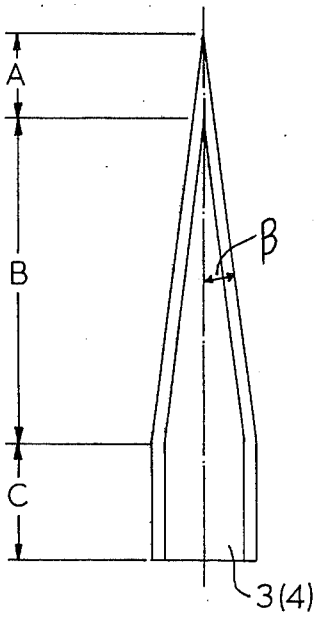
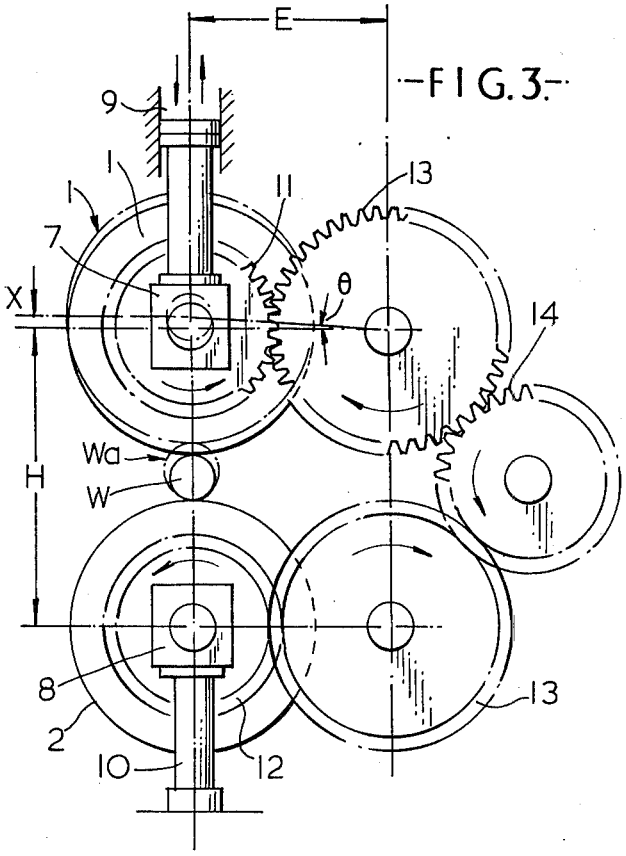
FIG. 3.

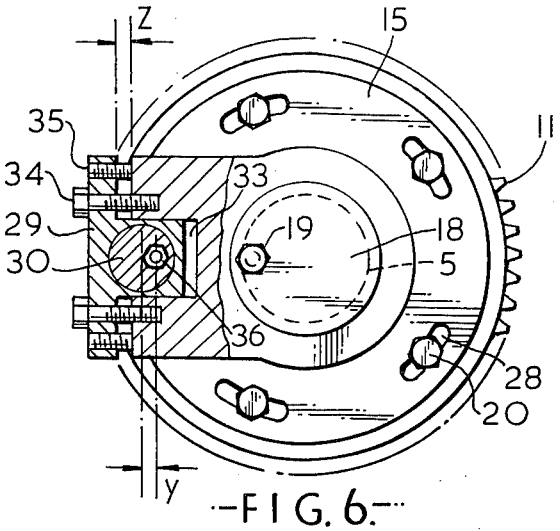
-FIG. 6-
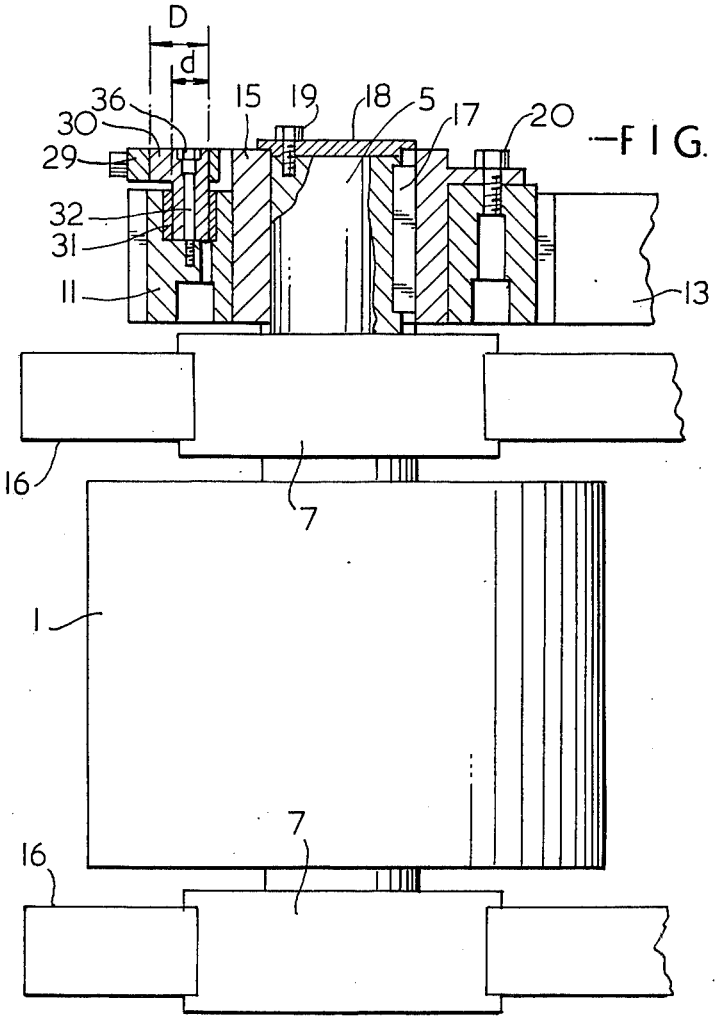
-FIG. 7-

DEVICE FOR ADJUSTING THE PHASE OF ROLL DIES IN A CROSS-ROLLING MACHINE

The present invention relates to improvements in phase adjustment between roller dies in a cross rolling machine.

In a cross rolling machine, as is shown in FIGS. 1 and 2 of the accompanying drawings, a work piece W is formed between roll dies 3, 4 which are respectively secured to the outer peripheral surface of a pair of upper and lower die rolls 1, 2. The die rolls are journalled for rotation parallel to one another in a frame (not shown) by means of roll shafts 5 and 6 respectively. The raw material W is forcibly rotated by the roll dies 3, 4 when both rolls 1, 2 are rotated in the same direction as one another at the same speed. In this case, the forming operation is completed after one complete revolution of each of the upper and lower rolls 1, 2. The FIGS. 1 and 2 $\alpha$ is the wedge angle of the die, $\beta$ is the advance angle, A is the bite portion, B the widening forming portion and C the finishing forming portion.

As can be seen from FIG. 3 the rolls 1, 2 are adapted to be rotated by the drive force transmitted to driving gears 11, 12 for the respective rolls through idler gears 13, from an intermediate gear 14 to which the driving power of a driving source (not shown) is transmitted. The roll shafts 5, 6 are supported by respective roll shaft bearing boxes 7, 8 which are housed on the inside of the frame. One of the bearing boxes 7 is held and secured by means of a roll distance adjusting device 9, normally constructed by hydraulic cylinder or a screwthread mechanism such as a work jack so that the standard distance H between the roll shafts can be varied by the device 9 in dependence upon the outer diameter of the raw material W to be formed, by moving the roll shaft bearing box 7 upwardly or downwardly by an increment X. The other roll shaft bearing box 8 is held in one position and fixedly secured by means of a roll fixing portion 10.

The stays between the die rolls 3, 4 must be accurate and held in a predetermined position because the forming operation is so carried out that the die rolls 3, 4 are driven with the balanced portions thereof (the portions having the same shape) at all times aligned with one another.

However when the outer diameter of the raw material to be worked differs from that of the previous piece of raw material the roll shaft bearing box 7 must be shifted by an amount X as described above, the measuring angle between the roll driving gear 11 and the idler gear 13 is naturally altered by $\theta°$ so that the phase between the die rolls is altered as a result of the rotation in one direction of the roll gear 11 by an amount corresponding to the variation in X and $\theta°$. When this happens it is necessary to adjust the angular position of one of the roll dies so as to correct the phase between the dies.

One device has already been proposed for correcting the phase of roll dies and this device will be described hereafter with reference to FIGS. 4 and 5 of the accompanying drawings.

In FIGS. 4 and 5 the roll shaft 5 of the roll 1 is journalled in a roll shaft bearing box 7 housed in a frame 16. On one side of the frame the shaft 5 extends beyond the bearing box 7 and the extended end carries a boss 15 which is fixedly secured for rotation with the shaft by a key 17. A retainer cover 18 is secured between the outer end surface of the boss 15 and the outer end surface of the roll shaft 5 by means of a bolt 19, thereby preventing the boss 15 from being withdrawn from the roll shaft 5. A roll driving gear 11 is rotatable about the outer periphery of the boss 15 and is held against axial movement relative thereto. Apertured pins 23 are mounted on the roll driving gear 11 by means of bolts 27 and washers 26. The roll driving gear 11 can be fixedly secured to the boss 15 by fastening bolt 20, in any angular position with respect to the boss 15 within the range of the length of elongate obturate grooves 28 provided in the boss 15.

Pins 21 fitted on the boss 15 have the eyes of eyebolts 22 rotatably fitted thereto so that the bolt portions of the eyebolts 22 can be inserted through the holes of the pins 23. Adjusting nuts 24, 25 are then secured to the bolt portions of the bolts 22 at both sides of the pins 23. The adjusting of the angle of the roll driving gear 11 with respect to the roll shaft 5 can be effected by loosening the fastening bolt 20, appropriately adjusting the nuts 24, 25 so as to rotate the roll driving gear with respect to the boss through the eyebolts 23 by the required amount, and, thereafter, refastening the bolt 20 through the slots 28 so as to secure the roll driving gear 11 to the boss 15. The rotating force transmitted from a driving source (not shown) to the roll driving gear 11 through the intermediate gear and the idler gear (see FIG. 3) is transmitted from the roll driving gear 11 to the roll shaft 5 through pins 23, adjusting nuts 24, 25, eyebolts 22, pins 21, boss 15, etc.

The device shown in FIGS. 4 and 5 is time consuming and troublesome because the adjusting nuts 24 and 25 have to be loosened and fastened manually each time the adjustment is effected in addition to the loosened and fastened of the bolts 20. Also when the device is used for long lengths of time the eyebolts 22 tend to become bent and the threaded portions thereof are crushed making the adjustment operation more and more difficult as time goes on, the frequent interchanging of the parts which thus becomes necessary will require the roll driving gear and the boss to be disassembled.

A further device for adjusting the phase of roll dies is disclosed in Japanese Patent Publication No. 40184/72. In this machine a worm gear device is used with the phase adjusting mechanism. The arrangements required to improve the working accuracy of this mechanism renders manufacturing costs expensive besides the worm gear device large in the construction is complicated.

The object of the present invention is to provide an apparatus for cross rolling machine incorporating an improved phase adjusting mechanism.

According to the present invention there is provided an apparatus suitable for adjusting the phase between die rolls in a cross rolling machine, the apparatus comprising a die roll mounted on a roll shaft for rotation by the roll shaft, a boss fixedly secured to the roll shaft for rotation therewith, and a drive gear coaxial with the boss, and coupled to the boss, so as to be angularly adjustable with respect thereto, by means of an eccentric cam shaft, whereby rotation of the cam shaft causes angular displacement between the driving gear and the roll shaft.

For a better understanding of the present invention and to show how it may be carried into effect, reference will now be made, by way of example, to FIGS. 6 and 7 of the accompanying drawings, in which:

FIG. 1 is a schematic perspective view of a pair of the rolls of a cross rolling machine;

FIG. 2 is a developed view of the die of FIG. 1;

FIG. 3 is a schematic view of the drive for the rolls of FIGS. 1 and 2;

FIG. 6 is an end view, partially in section, of a phase adjustment apparatus in accordance with the invention; and FIG. 7 is a plan view, partially in section, of the apparatus of FIG. 6.

Figure 4:
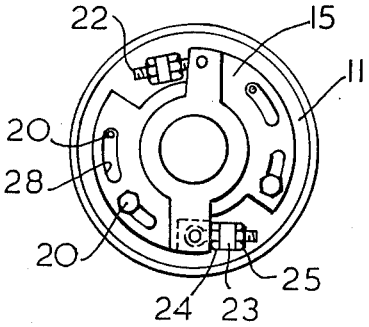
FIG. 4 PRIOR ART
FIG. 4 is an end view of a phase adjustment apparatus according to the prior art.
Figure 5:
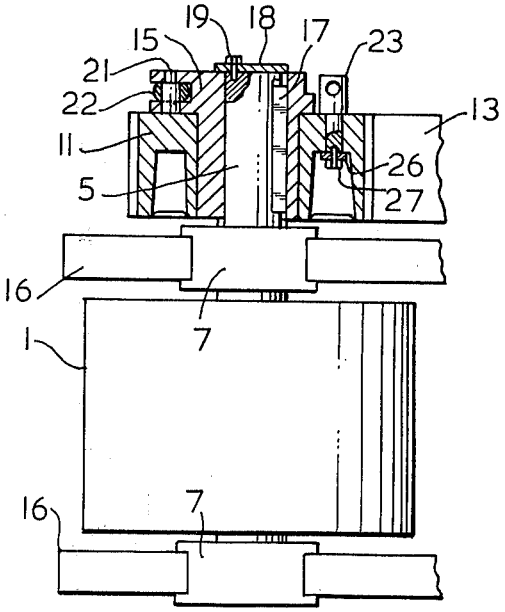
FIG. 5 PRIOR ART
FIG. 5 is a plan view partially in section of the adjustment apparatus of FIG. 4.

The mechanism shown in FIGS. 6 and 7 is used in a machine having the features already discussed with reference to FIGS. 1 to 3. The parts of FIGS. 6 and 7 that are equivalent or identical to parts in FIGS. 1 to 5 carry the same reference numerals. Thus a roll 1 has a shaft 5 journalled in bearings 7 which are mounted on opposite sides of the frame 16. An extension of the shaft 5 is surrounding by a boss 15 which is keyed to the shaft 5 by means of key 17. A retainer cover 18 is attached across the outer surfaces of the roll shaft 5 and the boss 15 by means of a bolt 19 as described with reference to FIG. 5. As is described with reference to the prior art the rotative force is transmitted to the roll by means of a roll driving gear 11 mounted on the outer periphery of the boss so as to be rotatable with respect thereto over a predetermined angle, but not displaceable coaxially thereof. The roll driving gear 11 can be secured to the boss 15 by means of bolts 20 each passing through a respective one of a plurality of elongate slots 28 provided in the boss 15 circumferentially thereof so that the secured position of the gear 11 is adjustable with respect to the boss. This construction is substantially similar to that shown in FIGS. 4 and 5 described above.

A cylindrical sleeve 31 is fitted in a bore provided in the roll driving gear 11 with an axis parallel to the axis of the shaft 5. At an appropriate position therein an eccentric cam shaft 30 is rotatably fitted in the sleeve 31 and is held against axial movement in the bore by a bolt 32 threadedly engaged with the roll driving gear 11. The bolt 32 serves to prevent the cam shaft 30 from being removed from the sleeve 31 is preferably in the form of a stepped configuration as shown in FIG. 7. The eccentric cam shaft 30 is constituted by an enlarged diameter shaft portion D and a reduced diameter shaft portion d, the center axes of the shaft portions being shifted eccentrically from one another by an eccentricity Y which is half the amount of the total displacement necessary for adjusting the position of the roll driving gear 11 from one extreme to the other. The enlarged diameter shaft portion D is adapted to be rotated about the bolt 32 as the center of rotation, the axis of the bolt 32 being the central axis of the reduced diameter portion d.

The large diameter portion of the eccentric cam shaft 30 is mounted in a bracket 29 which is radially slidable in a grooved portion 33 provided in the boss 15, as shown in FIG. 6. After a phase adjustment between the roll 5 and the gear 11 has been made the position of the bracket 29 can be fixedly secured with respect to the boss 15 by a pair of securing bolts 34. The action of the securing bolts 34 is reinforced by a pair of screws 35 which pass through threaded holes in the bracket 29 and bear against the face of the boss 15 and prevent the bolts 34 loosening. In practice, the firm securing of the bracket 29 to the boss 15 by means of the securing bolts 34 is effected after the screws 35 have been tightly fixed. The bracket 29 performs the transmission of driving force from the roll driving gear 11 to the roll shaft 5 through the eccentric cam shaft 30. In a small size machine, however, where the driving force is relatively small, the driving force may be directly transmitted to the roll shaft 5 by contacting the enlarged diameter shaft portion D of the eccentric cam shaft 30 with the grooved portion 33 of the boss 15 instead of transmitting the driving force through the bracket 29.

For adjusting the phase relationship between the roll 5 and the gear 11 a hexagonal hole 36 is provided in the eccentric cam shaft 30 as shown in FIG. 7 and the eccentric cam shaft 30 is rotated about the bolt 32 as the center of the rotation thereof by means of an appropriate tool. In the drawings, 13 designates an idler gear meshing with roll driving gear 11.

In operation of the phase adjusting mechanism described, for adjusting the phase difference of the die rolls, fastening bolts 20 are first loosened to free the connection of the roll driving gear 11 and the boss 15 and, thereafter, the securing bolts 34 and screws 35 are loosened so that bracket 29 becomes movable in the grooved portion 33 of the boss 15. Then, a wrench is fitted in the hexagonal hole 36 of the eccentric cam shaft 30 so as to rotate the eccentric cam shaft 30 about the bolt 32 in either direction by an appropriate amount depending upon the amount of displacement X required with respect to the standard distance H between the axes of the die rolls (see FIG. 3) and whether the displacement is positive or negative. Thus, the bracket 29 is displaced by a required amount in either a leftward or a rightward direction along the grooved portion 33 of the boss 15 at the contact surface of the enlarged diameter shaft portion D of the eccentric cam shaft 30 with the bracket 29. Then, screws 35, securing bolts 34 and fastening bolts 20, etc. are fastened in that order so that roll driving gear 11 and boss 15 are secured to each other, thereby permitting the adjustment of the phase difference of the roll dies to be completed.

In adjusting the phase difference of the roll dies, the fastening bolts, the securing bolts 34, the screws 35, etc. and manipulated so as to enable the eccentric cam shaft to rotate appropriately depending upon the amount of adjustment required. This arrangement is suitably applied to all types of compact size machines and large type machines, and also exhibits practical effectiveness in that, in maintenance and inspection, interchanging of bracket 29 and eccentric cam shaft 30 only is required without the necessity of disassembling the roll driving gear 11 and the boss 15.

The adjusting operation can be made far easier when appropriate scale means is provided between the eccentric cam shaft 30 and bracket 29 so as to permit the angle of rotation of the eccentric cam shaft 30 to be read off.

What we claim is:

1. Apparatus for adjusting the phase between roll dies in a cross-rolling machine that includes a die roll having a roll shaft extending axially therefrom, said apparatus including:

a. an annular boss coaxially received on said roll shaft;

b. means securing the boss to the roll shaft for rotation with said roll shaft;

c. a drive gear coaxially received on said roll shaft;

d. means releasably securing the drive gear to the boss and arranged to provide, when released, limited angular movement between the drive gear and the boss, whereby the drive gear may be angularly adjusted relative to the roll shaft by releasing said releasably securing means, moving the drive gear angularly relative to the boss to the desired degree, and resecuring said releasable securing means;

e. said boss including means defining a radially outwardly opening groove;

f. a bracket radially slidably mounted in said groove;

g. means for releasably adjustably fixing the bracket to the boss, whereby the relative radial relation of the bracket to the groove may be adjusted by releasing said fixing means, moving the bracket radially the desired amount and refixing said fixing means;

h. means providing an axially extending cavity in the bracket intermediate the radial extent of the bracket, said cavity having an axially extending peripheral sidewall;

i. cam means received in the cavity and journalled by eccentric cam shaft on the drive gear, with an offset from the geometric center of said peripheral sidewall, for rotation in contact with said peripheral sidewall;

j. said cam means having means providing an externally accessable wrenching surface thereon wherewith said cam may be engaged for rotation; whereby, when a change in the relative angular relation of the drive gear to the roll shaft is desired, the means (d) and (g) are released, said wrenching surface of said cam means is wrenched to turn the cam means and thus move the bracket radially in the groove and the drive gear angularly relative to the boss, then the means (d) is resecured and the means (g) is reset.

2. Apparatus according to claim 1, in which the eccentric cam shaft has a first part of relatively smaller diameter and a second part of relatively larger diameter, the centers of the first and second parts being displaced from one another, wherein the first part is secured for rotation in a bore in the drive gear with its axis parallel to that of the drive gear, and the second part is disposed in said bracket, whereby rotation of the cam shaft about the axis of the first part causes simultaneous radial movement of the bracket in the groove and angular displacement between the drive gear and the boss.

3. Apparatus according to claim 2, wherein a pair of fixing bolts is provided as said means for securing the bracket to the boss after an adjustment has been made.

4. Apparatus according to claim 3, wherein a pair of screws is additionally provided which engage in respective screw threaded bores in the bracket and are movable in said bores to engage a respective facing surface of the boss in order to maintain the adjusted position of the bracket in the groove.

5. Apparatus according to claim 2, wherein a polygonal bore is provided in the second part of the cam shaft on the axis of the first part as said wrenching surface whereby the cam shaft can be rotated by an appropriate tool.

* * * * *